US011335241B2

(12) United States Patent
Yue et al.

(10) Patent No.: US 11,335,241 B2
(45) Date of Patent: May 17, 2022

(54) SUB PIXEL CIRCUIT, PIXEL CIRCUIT, DRIVING METHOD THEREOF, DISPLAY MODULE AND DISPLAY DEVICE

(71) Applicant: BOE TECHNOLOGY GROUP CO., LTD., Beijing (CN)

(72) Inventors: Han Yue, Beijing (CN); Minghua Xuan, Beijing (CN); Ning Cong, Beijing (CN); Can Zhang, Beijing (CN); Can Wang, Beijing (CN); Detao Zhao, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 302 days.

(21) Appl. No.: 16/612,887

(22) PCT Filed: Apr. 11, 2019

(86) PCT No.: PCT/CN2019/082199
§ 371 (c)(1),
(2) Date: Nov. 12, 2019

(87) PCT Pub. No.: WO2019/237809
PCT Pub. Date: Dec. 19, 2019

(65) Prior Publication Data

US 2021/0358390 A1 Nov. 18, 2021

(30) Foreign Application Priority Data

Jun. 14, 2018 (CN) ..... 201810613582.9

(51) Int. Cl.
*G09G 3/32* (2016.01)
*G09G 3/20* (2006.01)
*G09G 3/3233* (2016.01)

(52) U.S. Cl.
CPC ..... *G09G 3/32* (2013.01); *G09G 3/2074* (2013.01); *G09G 3/3233* (2013.01);
(Continued)

(58) Field of Classification Search
CPC ..... G09G 3/2074; G09G 3/30; G09G 3/32; G09G 3/3208; G09G 3/3225;
(Continued)

(56) References Cited

U.S. PATENT DOCUMENTS 10,930,203 B2 * 2/2021 Yue ..... G09G 3/32
2005/0017934 A1 1/2005 Chung et al.
(Continued)

FOREIGN PATENT DOCUMENTS

CN 1577453 A 2/2005
CN 101086818 A 12/2007
(Continued)

OTHER PUBLICATIONS

First Office Action for Chinese Application No. 201810613582.9, dated Sep. 25, 2019, 10 Pages.
(Continued)

*Primary Examiner* — Jason M Mandeville
(74) *Attorney, Agent, or Firm* — Brooks Kushman P.C.

(57) ABSTRACT

What is described above are optional embodiments of the present disclosure. It should be noted that, for those of ordinary skills in the art, several modifications and refinements may be made without departing from the principle of the present disclosure. These modifications and refinements should also be considered to be within the scope of the present disclosure. What is described above are optional embodiments of the present disclosure. It should be noted that, for those of ordinary skills in the art, several modifications and refinements may be made without departing from the principle of the present disclosure. These modifi-
(Continued)

cations and refinements should also be considered to be within the scope of the present disclosure.

9 Claims, 10 Drawing Sheets

(52) U.S. Cl.
CPC ..... *G09G 2300/0426* (2013.01); *G09G 2300/0842* (2013.01); *G09G 2300/0866* (2013.01); *G09G 2330/021* (2013.01)

(58) Field of Classification Search
CPC ..... G09G 3/3233; G09G 2300/0426; G09G 2300/0809; G09G 2300/0842; G09G 2300/0866; G09G 2320/0233; G09G 2330/021
USPC ..... 345/76, 691
See application file for complete search history.

(56) References Cited

U.S. PATENT DOCUMENTS

| | | | | |
|---|---|---|---|---|
| 2008/0079670 | A1 | 4/2008 | Asano | |
| 2008/0316150 | A1 | 12/2008 | Lee et al. | |
| 2010/0245331 | A1 | 9/2010 | Shirouzu et al. | |
| 2010/0295758 | A1 | 11/2010 | Kawabe | |
| 2012/0044240 | A1 | 2/2012 | Chung et al. | |
| 2013/0088165 | A1 | 4/2013 | Wang et al. | |
| 2013/0169702 | A1 | 7/2013 | Ono | |
| 2014/0333677 | A1* | 11/2014 | Kim | G09G 3/3283 345/690 |
| 2014/0362130 | A1* | 12/2014 | Duan | G09G 3/3225 345/690 |
| 2015/0070408 | A1 | 3/2015 | Lim et al. | |
| 2016/0365031 | A1 | 12/2016 | Wu et al. | |
| 2017/0278455 | A1 | 9/2017 | Li et al. | |
| 2018/0151132 | A1 | 5/2018 | Lee et al. | |

FOREIGN PATENT DOCUMENTS

| | | | |
|---|---|---|---|
| CN | 101329836 | A | 12/2008 |
| CN | 101809643 | A | 8/2010 |
| CN | 101897025 | A | 11/2010 |
| CN | 103080996 | A | 5/2013 |
| CN | 103310730 | A | 9/2013 |
| CN | 103440840 | A | 12/2013 |
| CN | 104157239 | A | 11/2014 |
| CN | 105096831 | A | 11/2015 |
| CN | 106782310 | A | 5/2017 |
| CN | 108133688 | A | 6/2018 |
| CN | 108470537 | A | 8/2018 |
| JP | 2008089684 | A | 4/2008 |

OTHER PUBLICATIONS

International Search Report and Written Opinion for Application No. PCT/CN2019/082199, dated Jul. 3, 2019, 13 Pages.

* cited by examiner

SUB PIXEL CIRCUIT, PIXEL CIRCUIT, DRIVING METHOD THEREOF, DISPLAY MODULE AND DISPLAY DEVICE

CROSS-REFERENCE TO RELATED APPLICATIONS

This application is the U.S. national phase of PCT Application No. PCT/CN2019/082199 filed on Apr. 11, 2019, which claims priority to Chinese Patent Application No. 201810613582.9 filled on Jun. 14, 2018, which are incorporated herein by, reference in their entireties.

TECHNICAL FIELD

The present disclosure relates to the field of display technology, in particular to a subpixel circuit, a pixel circuit, driving method thereof, a display module and a display device.

BACKGROUND

Micro Light-Emitting Diode (MicroLED) is a self-luminous element, and at a low current density, its luminous efficiency decreases along with a decrease in the current density. A light-emitting element is driven by different current densities to emit light beams at different brightness values, so as to display an image at different grayscale values.

SUMMARY

An object of the present disclosure is to provide a subpixel circuit, a pixel circuit, driving methods thereof, a display module and a display device, so as to solve problems in the related art.

In one aspect, the present disclosure provides in some embodiments a subpixel circuit, including a data voltage write-in circuit, a driving circuit, a storage circuit, a light-emitting time control circuit, a light-emitting control circuit and a light-emitting element. The data voltage write-in circuit is connected to a voltage write-in control end, a first data signal end and a control end of the driving circuit, and configured to, at a data voltage write-in stage, write a data voltage from the first data signal end into the control end of the driving circuit under the control of the voltage write-in control end. The light-emitting time control circuit is connected to a light-emitting time control end, a second data signal end and a control end of the light-emitting control circuit, and configured to, at a light-emitting time control stage, write a light-emitting control signal from the second data signal end into the control end of the light-emitting control circuit under the control of the light-emitting time control end. A first end of the driving circuit is connected to a first voltage input end, a second end of the driving circuit is connected to a first end of the light-emitting control circuit, a second end of the light-emitting control circuit is connected to a first electrode of the light-emitting element, and a second electrode of the light-emitting element is connected to a second voltage input end. A first end of the storage circuit is connected to the control end of the driving circuit, and a second end of the storage circuit is connected to the first voltage input end. The storage circuit is configured to control a potential at the control end of the driving circuit. The light-emitting control circuit is configured to, within a light-emitting time period of the light-emitting time control stage, enable the second end of the driving circuit to be electrically connected to the first electrode of the light-emitting element under the control of the light-emitting control signal, so as to enable the driving circuit to drive the light-emitting element to emit light in accordance with the data voltage.

In a possible embodiment of the present disclosure, the light-emitting time control circuit includes a light-emitting time control transistor, a gate electrode of which is connected to the light-emitting time control end, a first electrode of which is connected to the second data signal end, and a second electrode of which is connected to the control end of the light-emitting control circuit.

In a possible embodiment of the present disclosure, the light-emitting control circuit includes a light-emitting control transistor, a gate electrode of which is the control end of the light-emitting control circuit, a first electrode of which is the first end of the light-emitting control circuit, and a second electrode of which is the second end of the light-emitting control circuit.

In a possible embodiment of the present disclosure, the data voltage write-in circuit includes a data voltage write-in transistor, a gate electrode of which is connected to the voltage write-in control end, a first electrode of which is connected to the first data signal end, and a second electrode of which is connected to the control end of the driving circuit.

In a possible embodiment of the present disclosure, the driving circuit includes a driving transistor, a gate electrode of which is the control end of the driving circuit, a first electrode of which is the first end of the driving circuit, and a second electrode of which is the second end of the driving circuit. The storage circuit includes a storage capacitor, a first end of which is connected to the control end of the driving circuit, and a second end of which is connected to the first voltage input end.

In another aspect, the present disclosure provides in some embodiments a method of driving the above-mentioned subpixel circuit. A display period of the subpixel circuit includes a data voltage write-in stage and a light-emitting time control stage arranged one after another. The method includes: at the data voltage write-in stage, writing, by a data voltage write-in circuit, a data voltage from a first data signal end into a control end of a driving circuit under the control of a voltage write-in control end, and maintaining, by a storage circuit, a potential at the control end of the driving circuit; at the light-emitting time control stage, maintaining, by the storage circuit, the potential at the control end of the driving circuit, and writing, by a light-emitting time control circuit, a light-emitting control signal from a second data signal end into a control end of a light-emitting control circuit under the control of a light-emitting time control end; and within a light-emitting time period of the light-emitting time control stage, enabling, by the light-emitting control circuit, a second end of the driving circuit to be electrically connected to a first electrode of a light-emitting element under the control of the light-emitting control signal, so as to enable the driving circuit to drive the light-emitting element to emit light in accordance with the data voltage.

In yet another aspect, the present disclosure provides in some embodiments a pixel circuit connected to N data lines and including a light-emitting time control circuit and N subpixel circuits, where N is an integer greater than or equal to 2. The light-emitting time control circuit is connected to a light-emitting time control gate line, a control end of a light-emitting control circuit of each of the N subpixel circuits, and one of the N data lines, and configured to, at a light-emitting time control stage, write a light-emitting control signal from the one data line into the control end of the light-emitting control circuit of each of the N subpixel circuits under the control of the light-emitting time control gate line. An $n^{th}$ subpixel circuit includes an $n^{th}$ data voltage write-in circuit, an $n^{th}$ driving circuit, an $n^{th}$ storage circuit, an $n^{th}$ light-emitting control circuit and an $n^{th}$ light-emitting element, where n is a positive integer smaller than or equal to N. The $n^{th}$ data voltage write-in circuit is connected to a voltage write-in control gate line, a control end of the $n^{th}$ driving circuit and an $n^{th}$ data line of the N data lines, and configured to, at a data voltage write-in stage, write an $n^{th}$ data voltage from the $n^{th}$ data line into the control end of the $n^{th}$ driving circuit under the control of the voltage write-in control gate line. A first end of the $n^{th}$ driving circuit is connected to a first voltage input end, a second end of the $n^{th}$ driving circuit is connected to a first end of the $n^{th}$ light-emitting control circuit, a second end of the $n^{th}$ light-emitting control circuit is connected to a first electrode of the $n^{th}$ light-emitting element, and a second electrode of the $n^{th}$ light-emitting element is connected to a second voltage input end. A first end of the $n^{th}$ storage circuit is connected to the control end of the $n^{th}$ driving circuit, and a second end of the $n^{th}$ storage circuit is connected to the first voltage input end. The $n^{th}$ storage circuit is configured to control a potential at the control end of the $n^{th}$ driving circuit. The $n^{th}$ light-emitting control circuit is configured to, within a light-emitting time period of the light-emitting time control stage, enable the second end of the $n^{th}$ driving circuit to be electrically connected to the first electrode of the $n^{th}$ light-emitting element under the control of the light-emitting control signal, so as to enable the $n^{th}$ driving circuit to drive the $n^{th}$ light-emitting element to emit light in accordance with the $n^{th}$ data voltage.

In a possible embodiment of the present disclosure, the light-emitting time control circuit includes a light-emitting time control transistor, a gate electrode of which is connected to the light-emitting time control gate line, a first electrode of which is connected to the one data line of the N data lines, and a second electrode of which is connected to the control end of the light-emitting control circuit.

In a possible embodiment of the present disclosure, the $n^{th}$ light-emitting control circuit includes an $n^{th}$ light-emitting control transistor, a gate electrode of which is a control end of the $n^{th}$ light-emitting control circuit, a first electrode of which is the first end of the $n^{th}$ light-emitting control circuit, and a second electrode of which is the second end of the $n^{th}$ light-emitting control circuit.

In a possible embodiment of the present disclosure, the nth data voltage write-in circuit includes an $n^{th}$ data voltage write-in transistor, a gate electrode of which is connected to the voltage write-in control gate line, a first electrode of which is connected to the $n^{th}$ data line, and a second electrode of which is connected to the control end of the $n^{th}$ driving circuit.

In a possible embodiment of the present disclosure, the $n^{th}$ driving circuit includes an $n^{th}$ driving transistor, a gate electrode of which is the control end of the $n^{th}$ driving circuit, a first electrode of which is the first end of the $n^{th}$ driving circuit, and a second electrode of which is the second end of the $n^{th}$ driving circuit. The $n^{th}$ storage circuit includes an $n^{th}$ storage capacitor, a first end of which is connected to the control end of the $n^{th}$ driving circuit, and a second end of which is connected to the first voltage input end.

In still yet another aspect, the present disclosure provides in some embodiments a method of driving the above-mentioned pixel circuit. A display period of the pixel circuit includes a data voltage write-in stage and a light-emitting time control stage arranged one after another. The method includes: at the data voltage write-in stage, writing, by an $n^{th}$ data voltage write-in circuit, an $n^{th}$ data voltage from an $n^{th}$ data line into a control end of an $n^{th}$ driving circuit under the control of a voltage write-in control gate line, and maintaining, by an $n^{th}$ storage circuit, a potential at the control end of the $n^{th}$ driving circuit; at the light-emitting time control stage, writing, by a light-emitting time control circuit, a light-emitting control signal from one of N data lines into a control end of a light-emitting control circuit of each of N subpixel circuits under the control of a light-emitting time control gate line; and within a light-emitting time period of the light-emitting time control stage, enabling, by an $n^{th}$ light-emitting control circuit, a second end of the $n^{th}$ driving circuit to be electrically connected to a first electrode of an $n^{th}$ light-emitting element under the control of a light-emitting control signal, so as to enable the $n^{th}$ driving circuit to drive the $n^{th}$ light-emitting element to emit light in accordance with the $n^{th}$ data voltage, where N is an integer greater than or equal to 2, and n is a positive integer smaller than or equal to N.

In still yet another aspect, the present disclosure provides in some embodiments a pixel circuit connected to N data lines and including N above-mentioned subpixel circuits, where N is an integer greater than or equal to 2. A light-emitting time control circuit of each subpixel circuit of the N subpixel circuits is connected to a corresponding data line of the N data lines.

In still yet another aspect, the present disclosure provides in some embodiments a display module connected to N data lines and including N above-mentioned pixel circuits, where N is an integer greater than or equal to 2. A light-emitting time control circuit of each pixel circuit of the N pixel circuits is connected to a corresponding data line of the N data lines, and different light-emitting time control circuits of the N pixel circuits are connected to different data lines of the N data lines.

In still yet another aspect, the present disclosure provides in some embodiments a display device including the above-mentioned pixel circuit or the above-mentioned display module.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

In the related art, a current density of a MicroLED is adjusted so as to achieve different grayscale values. The MicroLED has a relatively low current density at a low grayscale value, so the luminous efficiency thereof is relatively low too, resulting in high power consumption.

An object of the present disclosure is to provide a subpixel circuit, a pixel circuit, driving methods thereof, a display module and a display device, so as to solve the problems in the related art where the luminous efficiency is low and the power consumption is high at a low grayscale value when a light-emitting element is driven by different current densities to emit light beams at different brightness values.

All transistors adopted in the embodiments of the present disclosure may be thin film transistors (TFTs), field effect transistors (FETs) or any other elements having same characteristics. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

Figure 1:
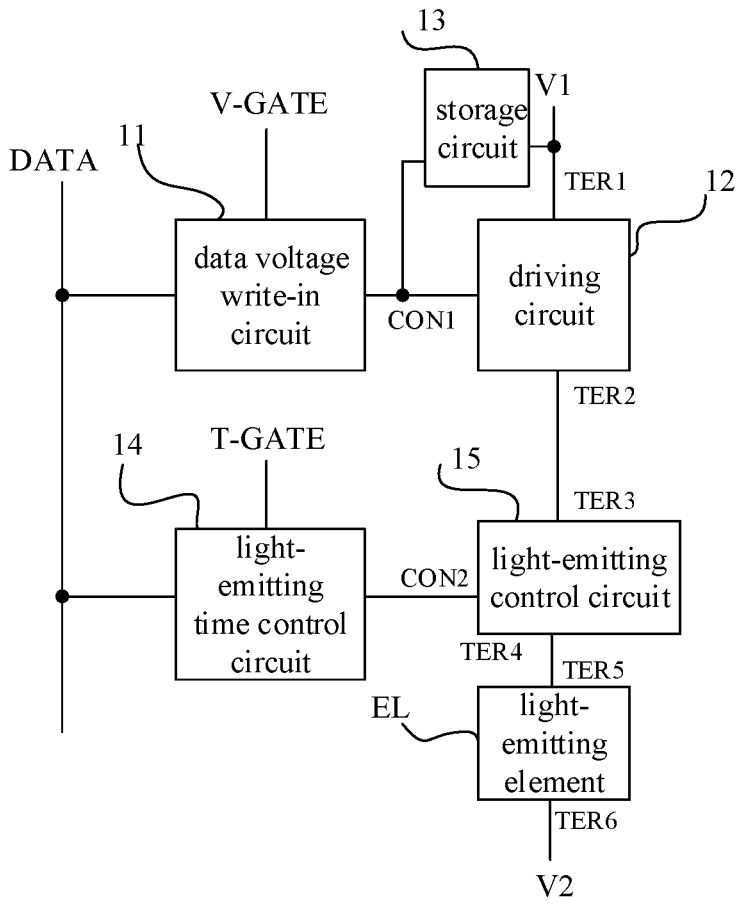
FIG. 1 is a schematic view showing a subpixel circuit according to one embodiment of the present disclosure.

The present disclosure provides in some embodiments a subpixel circuit which, as shown in FIG. 1, includes a data voltage write-in circuit 11, a driving circuit 12, a storage circuit 13, a light-emitting time control circuit 14, a light-emitting control circuit 15 and a light-emitting element EL. The data voltage write-in circuit 11 is connected to a voltage write-in control gate line V-GATE, a data line DATA and a control end CON1 of the driving circuit 12, and configured to, at a data voltage write-in stage, write a data voltage from the data line DATA into the control end CON1 of the driving circuit 12 under the control of the voltage write-in control gate line V-GATE.

The light-emitting time control circuit 14 is connected to a light-emitting time control gate line T-GATE, the data line DATA and a control end CON2 of the light-emitting control circuit 15, and configured to, at a light-emitting time control stage, write a light-emitting control signal from the data line DATA into the control end CON2 of the light-emitting control circuit 15 under the control of the light-emitting time control gate line T-GATE.

A first end TER1 of the driving circuit 12 is connected to a first voltage input end, a second end TER2 of the driving circuit 12 is connected to a first end TER3 of the light-emitting control circuit 15, a second end TER4 of the light-emitting control circuit 15 is connected to a first electrode of the light-emitting element EL, and a second electrode of the light-emitting element EL is connected to a second voltage input end. The first voltage input end is configured to input a first voltage V1, and the second voltage input end is configured to input a second voltage V2.

A first end of the storage circuit 13 is connected to the control end CON1 of the driving circuit 12, and a second end of the storage circuit 13 is connected to the first voltage input end. The storage circuit 13 is configured to control a potential at the control end CON1 of the driving circuit 12.

The light-emitting control circuit 15 is configured to, within a light-emitting time period of the light-emitting time control stage, enable the second end of the driving circuit 12 to be electrically connected to the first electrode of the light-emitting element EL under the control of the light-emitting control signal, so as to enable the driving circuit 12 to drive the light-emitting element EL to emit light in accordance with the data voltage.

According to the embodiments of the present disclosure, the light-emitting control signal is applied to the subpixel circuit through the light-emitting time control circuit, so as to control a light-emitting time, and control a light-emitting brightness value of the light-emitting element in accordance with the data voltage and the light-emitting time, thereby to improve the luminous efficiency, reduce the power consumption and achieve more grayscale values.

In actual use, the light-emitting element EL may be a MicroLED. At this time, the first electrode of the light-emitting element EL may be an anode and the second electrode of the light-emitting element EL may be a cathode. However, the light-emitting element EL may not be limited to the MicroLED. During the implementation, the light-emitting element EL may also be an Organic Light-Emitting Diode (OLED) or any other light-emitting element.

In actual use, the first voltage V1 may be a high voltage and the second voltage V2 may be a low voltage, but the present disclosure shall not be limited thereto.

During the implementation, the high voltage may be, but not limited to, a positive voltage greater than 3V, and the low voltage may be, but not limited to, a zero voltage or a negative voltage.

Figure 2:
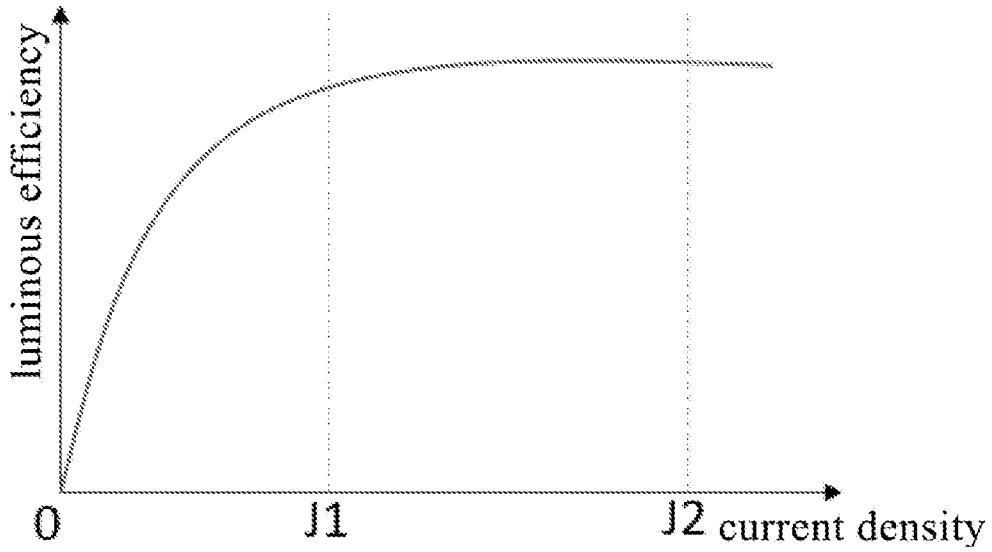
FIG. 2 is a curve diagram showing a relationship between current density and luminous efficiency of a MicroLED.

FIG. 2 shows a relationship between luminous efficiency and current density of the MicroLED as a self-luminous element (where a horizontal axis represents the current density and a longitudinal axis represents the luminous efficiency). At a low current density, the luminous efficiency of the MicroLED may decrease along with a decrease in the current density. Hence, when a grayscale value is adjusted through the current density, the luminous efficiency of the MicroLED may decrease because a low grayscale value corresponds to a low current density. In FIG. 2, J1 represents a first current density, and J2 represents a second current density.

In some embodiments of the present disclosure, the MicroLED may operate at a region where highest luminous efficiency is provided, i.e., the current density of the MicroLED may be between J1 and J2, so as to adjust the grayscale value in accordance with a current and a light-emitting time. Taking 256 grayscale values as an example, at high grayscale values (e.g., L120 to L255), the grayscale value may be adjusted through adjusting the current density. For example, the second current density J2 may correspond to L255, and the first current density J1 may correspond to L120, both with a light-emitting time proportion of 100%. At low grayscale values (e.g., grayscale values smaller than L120), the current density J1 may be maintained unchanged, and the grayscale value may be adjusted through adjusting the light-emitting time. For example, a current density corresponding to L40 may be the first current density J1, and a light-emitting time proportion corresponding to L40 may be 4.7%. L120 represents a $120^{th}$ grayscale value, L255 represents $255^{th}$ grayscale value, and L40 represents a $40^{th}$ grayscale value.

The present disclosure provides a driving scheme suitable for the MicroLED. In this scheme, the grayscale value may be adjusted in accordance with the current and the light-emitting time, so that the MicroLED may operate at a region where the luminous efficiency is relatively high. The high grayscale value may be achieved through adjusting a driving current, while the low grayscale value may be achieved through adjusting the light-emitting time.

During the operation of the subpixel circuit in FIG. 1, a display period of the subpixel circuit may include the data voltage write-in stage and the light-emitting time control stage arranged one after another.

At the data voltage write-in stage, the data voltage write-in circuit 11 may write the data voltage from the data line DATA into the control end CON1 of the driving circuit 12 under the control of the voltage write-in control gate line V-GATE, and the storage circuit 13 may maintain the potential at the control end CON1 of the driving circuit 12.

At the light-emitting time control stage, the storage circuit 13 may maintain the potential at the control end CON1 of the driving circuit 12. The light-emitting time control circuit 14 may write the light-emitting control signal from the data line DATA into the control end CON2 of the light-emitting control circuit 15 under the control of the light-emitting time control gate line T-GATE.

Within the light-emitting time period of the light-emitting time control stage, the light-emitting control circuit 15 may control the second end TER2 of the driving circuit 12 to be electrically connected to the first electrode TER5 of the light-emitting element EL under the control of the light-emitting control signal, so as to enable the driving circuit 12 to drive the light-emitting element EL to emit light in accordance with the data voltage.

To be specific, the light-emitting time control circuit 14 may include a light-emitting time control transistor, a gate electrode of which is connected to the light-emitting time control gate line, a first electrode of which is connected to the data line, and a second electrode of which is connected to the control end of the light-emitting control circuit.

To be specific, the light-emitting control circuit may include a light-emitting control transistor, a gate electrode of which is the control end of the light-emitting control circuit, a first electrode of which is the first end of the light-emitting control circuit, and a second electrode of which is the second end of the light-emitting control circuit.

To be specific, the data voltage write-in circuit may include a data voltage write-in transistor, a gate electrode of which is connected to the voltage write-in control gate line, a first electrode of which is connected to the data line, and a second electrode of which is connected to the control end of the driving circuit.

During the implementation, the driving circuit may include a driving transistor, a gate electrode of which is the control end of the driving circuit, a first electrode of which is the first end of the driving circuit, and a second electrode of which is the second end of the driving circuit. The storage circuit may include a storage capacitor, a first end of which is connected to the control end of the driving circuit, and a second end of which is connected to the first voltage input end.

Figure 3:
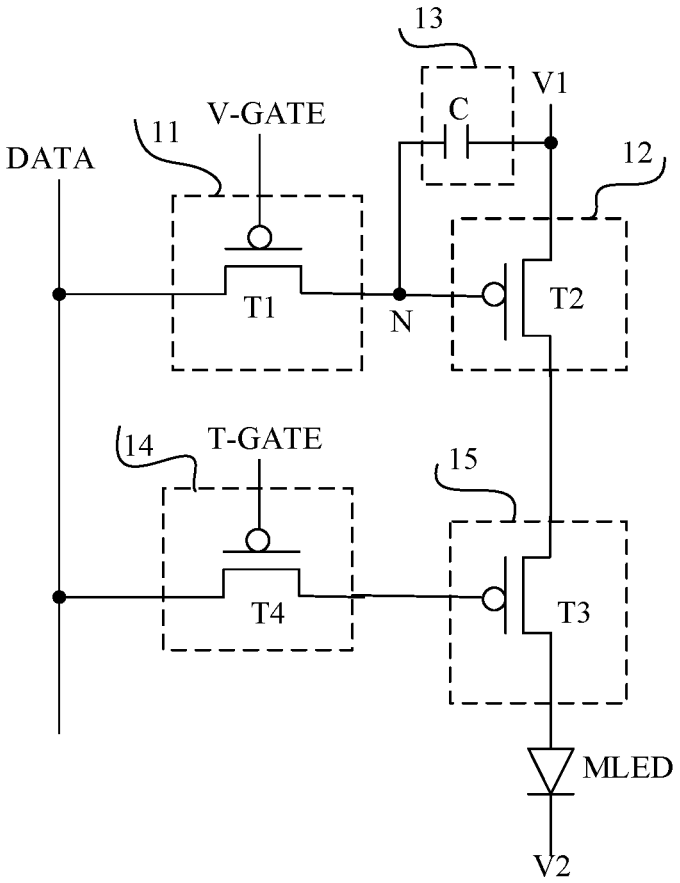
FIG. 3 is a circuit diagram of the subpixel circuit according to one embodiment of the present disclosure.

As shown in FIG. 3, the subpixel circuit may include the data voltage write-in circuit 11, the driving circuit 12, the storage circuit 13, the light-emitting time control circuit 14, the light-emitting control circuit 15 and a micro light-emitting diode MLED. The driving circuit 12 may include a driving transistor T2, and the light-emitting control circuit 15 may include a light-emitting control transistor T3.

The light-emitting time control circuit 14 may include a light-emitting time control transistor T4, a gate electrode of which is connected to the light-emitting time control gate line T-GATE, a source electrode of which is connected to the data line DATA, and a drain electrode of which is connected to a gate electrode of the light-emitting control transistor T3.

A source electrode of the light-emitting control transistor T3 may be connected to a drain electrode of the driving transistor T2, and a drain electrode of the light-emitting control transistor T3 may be connected to an anode of the micro light-emitting diode MLED.

The data voltage write-in circuit 11 may include a data voltage write-in transistor T1, a gate electrode of which is connected to the voltage write-in control gate line V-GATE, a source electrode of which is connected to the data line DATA, and a drain electrode of which is connected to a gate electrode of the driving transistor T2.

A source electrode of the driving transistor T2 may be configured to receive the first voltage V1. In FIG. 3, V1 may be a high voltage VDD.

The storage circuit 13 may include a storage capacitor C, a first end of which is connected to the gate electrode of the driving transistor T2, and a second end of which is configured to receive the first voltage V1.

A cathode of the micro light-emitting diode MLED is configured to receive the second voltage V2. In FIG. 3, V2 may be a low voltage VSS.

In FIG. 3, T1, T2, T3 and T4 may be, but not limited to, p-type transistors. In actual use, these transistors may also be n-type transistors.

The subpixel circuit in FIG. 3 is a 4T1C subpixel circuit in which T2 is the driving transistor and T1, T3 and T4 are switching transistors.

When V-GATE inputs a low level and T-GATE inputs a high level, T1 may be turned on and T4 may be turned off, so as to write the data voltage for controlling a driving current from DATA to a node N (in FIG. 3, the node N is a node connected to the gate electrode of T2), and store the data voltage in the storage capacitor C.

When T-GATE inputs a low level and V-GATE inputs a high level, T4 may be turned on and T1 may be turned off, so as to transmit the light-emitting control signal for controlling on and off states of T3 from DATA to the gate electrode of T3 via T4. When the light-emitting control signal is at a low level, T3 may be turned on, and MLED may emit light. When the light-emitting control signal is a high level, T3 may be turned off, and MLED may not emit light.

Figure 9:
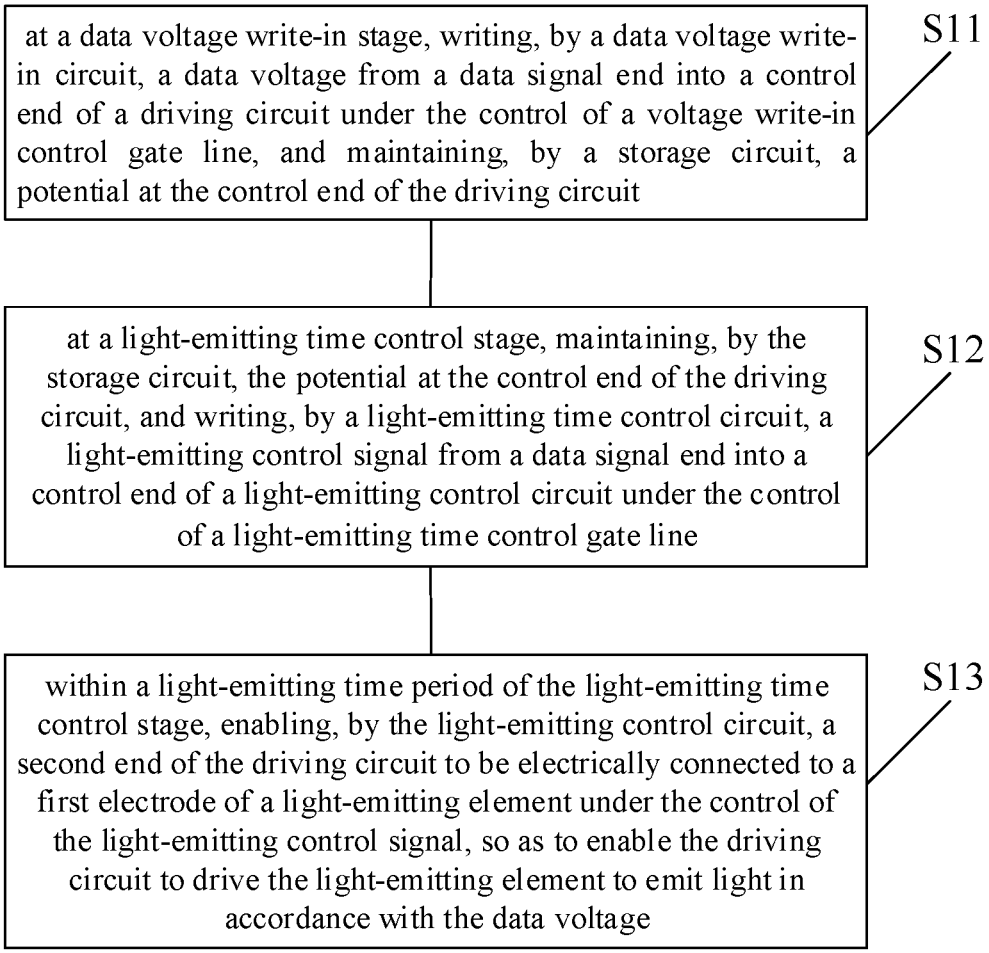
FIG. 9 is a flow chart of a method for driving the subpixel circuit in FIG. 1.

The present disclosure further provides in some embodiments a method of driving the above-mentioned subpixel circuit. A display period of the subpixel circuit includes a data voltage write-in stage and a light-emitting time control stage arranged one after another. As shown in FIG. 9, the method may include: Step S11 of, at the data voltage write-in stage, writing, by a data voltage write-in circuit, a data voltage from a first data signal end into a control end of a driving circuit under the control of a voltage write-in control gate line, and maintaining, by a storage circuit, a potential at the control end of the driving circuit; Step S12 of, at the light-emitting time control stage, maintaining, by the storage circuit, the potential at the control end of the driving circuit, and writing, by a light-emitting time control circuit, a light-emitting control signal from a data signal end into a control end of a light-emitting control circuit under the control of a light-emitting time control gate line; and Step S13 of, within a light-emitting time period of the light-emitting time control stage, enabling, by the light-emitting control circuit, a second end of the driving circuit to be electrically connected to a first electrode of a light-emitting element under the control of the light-emitting control signal, so as to enable the driving circuit to drive the light-emitting element to emit light in accordance with the data voltage.

According to the method in the embodiments of the present disclosure, the data voltage may be written to the control end of the driving circuit at the data voltage write-in stage, and then the light-emitting control signal from the data line may be written to the control end of the light-emitting control circuit at the light-emitting time control stage, so as to control the light-emitting element to emit light within the light-emitting time period.

The present disclosure further provides in some embodiments a pixel circuit connected to N data lines and including a light-emitting time control circuit and N subpixel circuits, where N is an integer greater than or equal to 2.

The light-emitting time control circuit is connected to a light-emitting time control gate line, a control end of a light-emitting control circuit and one of the N data lines, and configured to, at a light-emitting time control stage, write a light-emitting control signal from the one data line into the control end of the light-emitting control circuit of each of the N subpixel circuits under the control of the light-emitting time control gate line.

An $n^{th}$ subpixel circuit includes an $n^{th}$ data voltage write-in circuit, an $n^{th}$ driving circuit, an $n^{th}$ storage circuit, an $n^{th}$ light-emitting control circuit and an $n^{th}$ light-emitting element, where n is a positive integer smaller than or equal to N.

The $n^{th}$ data voltage write-in circuit is connected to a voltage write-in control gate line, a control end of the $n^{th}$ driving circuit and an $n^{th}$ data line of the N data lines, and configured to, at a data voltage write-in stage, write an $n^{th}$ data voltage from the $n^{th}$ data line into the control end of the $n^{th}$ driving circuit under the control of the voltage write-in control gate line.

A first end of the $n^{th}$ driving circuit is connected to a first voltage input end, a second end of the $n^{th}$ driving circuit is connected to a first end of the $n^{th}$ light-emitting control circuit, a second end of the $n^{th}$ light-emitting control circuit is connected to a first electrode of the $n^{th}$ light-emitting element, and a second electrode of the $n^{th}$ light-emitting element is connected to a second voltage input end.

A first end of the $n^{th}$ storage circuit is connected to the control end of the $n^{th}$ driving circuit, and a second end of the $n^{th}$ storage circuit is connected to the first voltage input end. The $n^{th}$ storage circuit is configured to control a potential at the control end of the $n^{th}$ driving circuit.

The $n^{th}$ light-emitting control circuit is configured to, within a light-emitting time period of the light-emitting time control stage, enable the second end of the $n^{th}$ driving circuit to be electrically connected to the first electrode of the $n^{th}$ light-emitting element under the control of the light-emitting control signal, so as to enable the $n^{th}$ driving circuit to drive the $n^{th}$ light-emitting element to emit light in accordance with the $n^{th}$ data voltage.

According to the embodiments of the present disclosure, the pixel circuit may include N subpixel circuits and one light-emitting time control circuit, and a light-emitting time of each of the N subpixel circuits may be controlled by the light-emitting time control circuit. In other words, the light-emitting time of the pixel circuit including N subpixel circuits may be controlled through one data line, and the light-emitting times of the N pixel circuits may be controlled through N data lines respectively. As a result, it is able to improve the luminous efficiency, reduce the power consumption, and reduce the quantity of the transistors and data lines while achieving more grayscale values.

The pixel circuit will be described herein after when N is 3.

Figure 4:
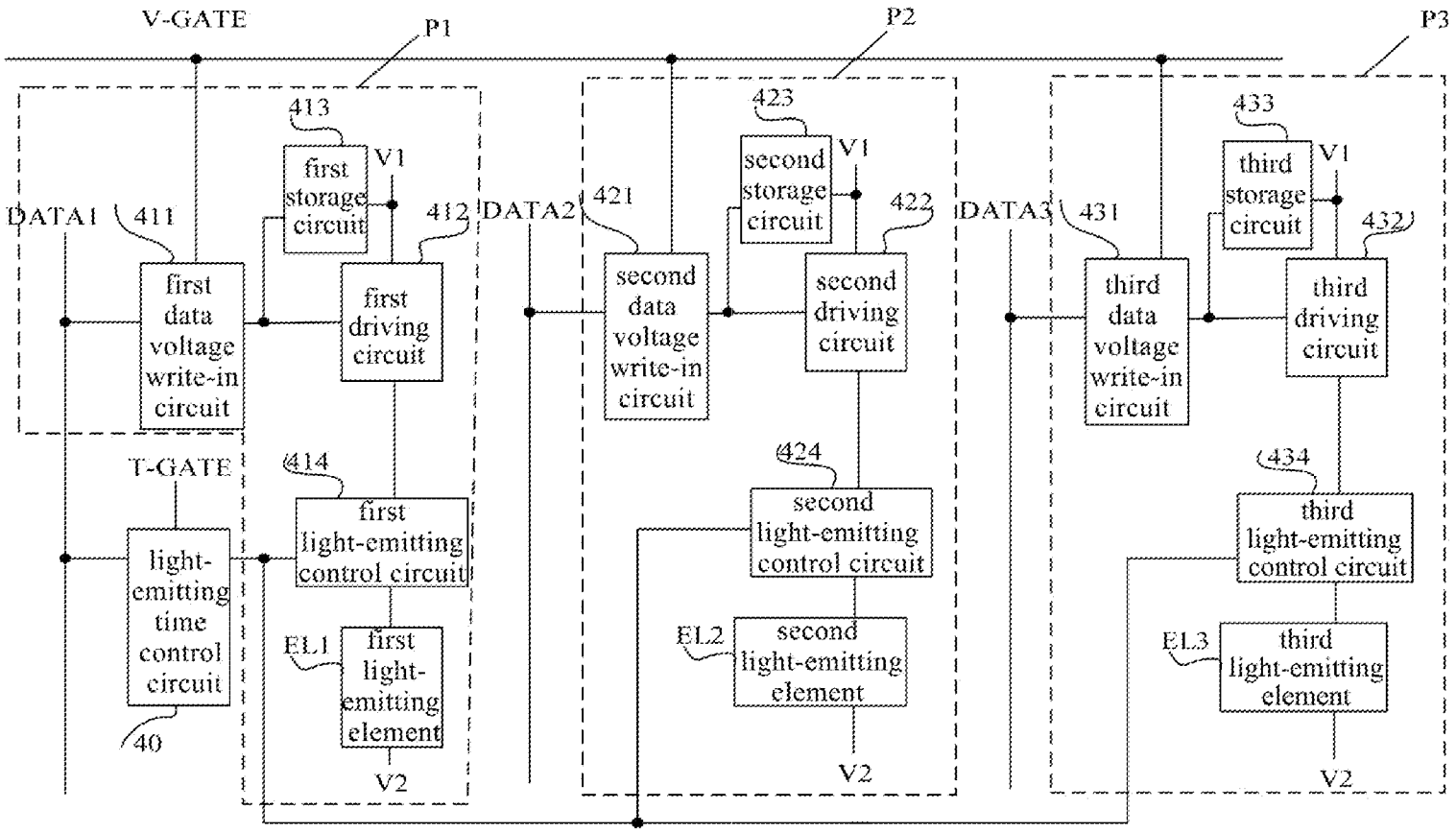
FIG. 4 is a schematic view showing a pixel circuit according to one embodiment of the present disclosure.

As shown in FIG. 4, the pixel circuit may include a light-emitting time control circuit 40, a first subpixel circuit P1, a second subpixel circuit P2 and a third subpixel circuit P3.

The first subpixel circuit P1 may be any one of a red subpixel circuit, a blue subpixel circuit and a green subpixel, the second subpixel circuit P2 may be any one of the red subpixel circuit, the blue subpixel circuit and the green subpixel different from the first subpixel circuit P1, and the third subpixel circuit P3 may be any one of the red subpixel circuit, the blue subpixel circuit and the green subpixel different from the first subpixel circuit P1 and the second subpixel circuit P2. For example, the first subpixel circuit P1 may be the red subpixel circuit, the second subpixel circuit P2 may be the blue subpixel circuit, and the third subpixel circuit P3 may be the green subpixel circuit.

The first subpixel circuit P1 may include a first data voltage write-in circuit 411, a first driving circuit 412, a first storage circuit 413, a first light-emitting control circuit 414 and a first light-emitting element EL1.

The second subpixel circuit P2 may include a second data voltage write-in circuit 421, a second driving circuit 422, a second storage circuit 423, a second light-emitting control circuit 424 and a second light-emitting element EL2.

The third subpixel circuit P3 may include a third data voltage write-in circuit 431, a third driving circuit 432, a third storage circuit 433, a third light-emitting control circuit 434 and a third light-emitting element EL3.

The light-emitting time control circuit 40 may be connected to a light-emitting time control gate line T-GAE, a control end of the first light-emitting control circuit 414, a control end of the second light-emitting control circuit 424, a control end of the third light-emitting control circuit 434 and a first data line DATA1, and configured to, at the light-emitting time control stage, write a light-emitting control signal from the first data line DATA1 into the control end of the first light-emitting control circuit 414, the control end of the second light-emitting control circuit 424, and the control end of the third light-emitting control circuit 434 respectively under the control of the light-emitting time control gate line T-GATE.

The first data voltage write-in circuit 411 may be connected to a voltage write-in control gate line V-GATE, a control end of the first driving circuit 412 and the first data line DATA1, and configured to, at the data voltage write-in stage, write a first data voltage from the first data line DATA1 into the control end of the first driving circuit 412 under the control of the voltage write-in control gate line V-GATE.

A first end of the first driving circuit 412 may receive the first voltage V1, a second end of the first driving circuit 412 may be connected to a first end of the first light-emitting control circuit 414, a second end of the first light-emitting control circuit 414 may be connected to a first electrode of the first light-emitting element EL1, and a second electrode of the first light-emitting element EL1 may receive the second voltage V2.

A first end of the first storage circuit 413 may be connected to the control end of the first driving circuit 412, and a second end of the first storage circuit 413 may receive the first voltage V1. The first storage circuit 413 is configured to control a potential at the control end of the first driving circuit 412.

The first light-emitting control circuit 414 is configured to, within the light-emitting time period of the light-emitting time control stage, enable the second end of the first driving circuit 412 to be electrically connected to the first electrode of the first light-emitting element EL1 under the control of the light-emitting control signal, so as to enable the first driving circuit 412 to drive the first light-emitting element EL1 to emit light in accordance with the first data voltage.

The second data voltage write-in circuit 421 may be connected to the voltage write-in control gate line V-GATE, a control end of the second driving circuit 422 and a second data line DATA2, and configured to, at the data voltage write-in stage, write a second data voltage from the second data line DATA2 into the control end of the second driving circuit 422 under the control of the voltage write-in control gate line V-GATE.

A first end of the second driving circuit 422 may receive the first voltage V1, a second end of the second driving circuit 422 may be connected to a first end of the second light-emitting control circuit 424, a second end of the second light-emitting control circuit 424 may be connected to a first electrode of the second light-emitting element EL2, and a second electrode of the second light-emitting element EL2 may receive the second voltage V2.

A first end of the second storage circuit 423 may be connected to the control end of the second driving circuit 422, and a second end of the second storage circuit 423 may receive the first voltage V1. The second storage circuit 423 is configured to control a potential at the control end of the second driving circuit 422.

The second light-emitting control circuit 424 is configured to, within the light-emitting time period of the light-emitting time control stage, enable the second end of the second driving circuit 422 to be electrically connected to the first electrode of the second light-emitting element EL2 under the control of the light-emitting control signal, so as to enable the second driving circuit 422 to drive the second light-emitting element EL2 to emit light in accordance with the second data voltage.

The third data voltage write-in circuit 431 may be connected to the voltage write-in control gate line V-GATE, a control end of the third driving circuit 432 and a third data line DATA3, and configured to, at the data voltage write-in stage, write a third data voltage from the third data line DATA3 into the control end of the third driving circuit 432 under the control of the voltage write-in control gate line V-GATE.

A first end of the third driving circuit 432 may receive the first voltage V1, a second end of the third driving circuit 432 may be connected to a first end of the third light-emitting control circuit 434, a second end of the third light-emitting control circuit 434 may be connected to a first electrode of the third light-emitting element EL3, and a second electrode of the third light-emitting element EL3 may receive the second voltage V2.

A first end of the third storage circuit 433 may be connected to the control end of the third driving circuit 432, and a second end of the third storage circuit 433 may receive the first voltage V1. The third storage circuit 433 is configured to control a potential at the control end of the third driving circuit 432.

The third light-emitting control circuit 434 is configured to, within the light-emitting time period of the light-emitting time control stage, enable the second end of the third driving circuit 432 to be electrically connected to the first electrode of the third light-emitting element EL3 under the control of the light-emitting control signal, so as to enable the third driving circuit 432 to drive the third light-emitting element EL3 to emit light in accordance with the third data voltage.

In the embodiments as shown in FIG. 4, the corresponding light-emitting control signal may be applied to the first subpixel circuit P1, the second subpixel circuit P2 and the third subpixel circuit P3 through DATA1, i.e., the light-emitting times of the red subpixel circuit, the green subpixel circuit and the blue subpixel in a same pixel circuit may be controlled through one data line (i.e., the first data line DATA1 in FIG. 4). In this regard, it is able to enable the pixel circuits in three rows simultaneously through three data lines. When one pixel circuit includes three data lines, it is able to enable the pixel circuits in three rows simultaneously.

In the embodiments of the present disclosure, it is able for the pixel circuit to modulate more grayscale values while ensuring the luminous efficiency. For example, when a current density of a driving current flowing through each light-emitting element is greater than or equal to the first current density J1 and smaller than or equal to the second current density J2, each light-emitting element may have the highest luminous efficiency. At this time, a largest grayscale value may correspond to the second current density J2 and a largest light-emitting time proportion, and a smallest grayscale value may correspond to the first current density J1 and a smallest light-emitting time proportion. In this way, it is able to increase a ratio of the largest grayscale value to the smallest grayscale value, thereby to achieve more grayscale values.

During the operation of the pixel circuit in FIG. 4, a display period of the pixel circuit may include the data voltage write-in stage and the light-emitting time control stage arranged one after another.

At the data voltage write-in stage, the first data voltage write-in circuit 411 may write the first data voltage from the first data line DATA1 into the control end of the first driving circuit 412 under the control of the voltage write-in control gate line V-GATE, and the first storage circuit 413 may maintain the potential at the control end of the first driving circuit 412. The second data voltage write-in circuit 421 may write the second data voltage from the second data line DATA2 into the control end of the second driving circuit 422 under the control of the voltage write-in control gate line V-GATE, and the second storage circuit 423 may maintain the potential at the control end of the second driving circuit 422. The third data voltage write-in circuit 431 may write the third data voltage from the third data line DATA3 into the control end of the third driving circuit 432 under the control of the voltage write-in control gate line V-GATE, and the third storage circuit 433 may maintain the potential at the control end of the third driving circuit 432.

At the light-emitting time control stage, the light-emitting time control circuit 40 may write the light-emitting control signal from the first data lien DATA1 into the control end of the first light-emitting control circuit 414, the control end of the second light-emitting control circuit 424 and the control end of the third light-emitting control circuit 424 under the control of the light-emitting time control gate line T-GATE.

Within the light-emitting time period of the light-emitting time control stage, the first light-emitting control circuit 414 may enable the second end of the first driving circuit 412 to be electrically connected to the first electrode of the first light-emitting element EL1 under the control of the light-emitting control signal, so as to enable the first driving circuit 412 to drive the first light-emitting element EL1 to emit light in accordance with the first data voltage. The second light-emitting control circuit 424 may enable the second end of the second driving circuit 422 to be electrically connected to the first electrode of the second light-emitting element EL2 under the control of the light-emitting control signal, so as to enable the second driving circuit 422 to drive the second light-emitting element EL2 to emit light in accordance with the second data voltage. The third light-emitting control circuit 434 may enable the second end of the third driving circuit 432 to be electrically connected to the first electrode of the third light-emitting element EL3 under the control of the light-emitting control signal, so as to enable the third driving circuit 432 to drive the third light-emitting element EL3 to emit light in accordance with the third data voltage.

To be specific, the light-emitting time control circuit may include a light-emitting time control transistor, a gate electrode of which is connected to the light-emitting time control gate line, a first electrode of which is connected to one data line of the N data lines, and a second electrode of which is connected to the control end of the light-emitting control circuit.

To be specific, the $n^{th}$ light-emitting control circuit may include an $n^{th}$ light-emitting control transistor, a gate electrode of which is the control end of the $n^{th}$ light-emitting control circuit, a first electrode of which is the first end of the $n^{th}$ light-emitting control circuit, and a second electrode of which is the second end of the $n^{th}$ light-emitting control circuit.

In actual use, the $n^{th}$ data voltage write-in circuit may include an $n^{th}$ data voltage write-in transistor, a gate electrode of which is connected to the voltage write-in control gate line, a first electrode of which is connected to the $n^{th}$ data line, and a second electrode of which is connected to the control end of the $n^{th}$ driving circuit.

During the implementation, the $n^{th}$ driving circuit may include an $n^{th}$ driving transistor, a gate electrode of which is the control end of the $n^{th}$ driving circuit, a first electrode of which is the first end of the $n^{th}$ driving circuit, and a second electrode of which is the second end of the $n^{th}$ driving circuit. The $n^{th}$ storage circuit may include an $n^{th}$ storage capacitor, a first end of which is connected to the control end of the $n^{th}$ driving circuit, and a second end of which is connected to the first voltage input end.

Figure 5:
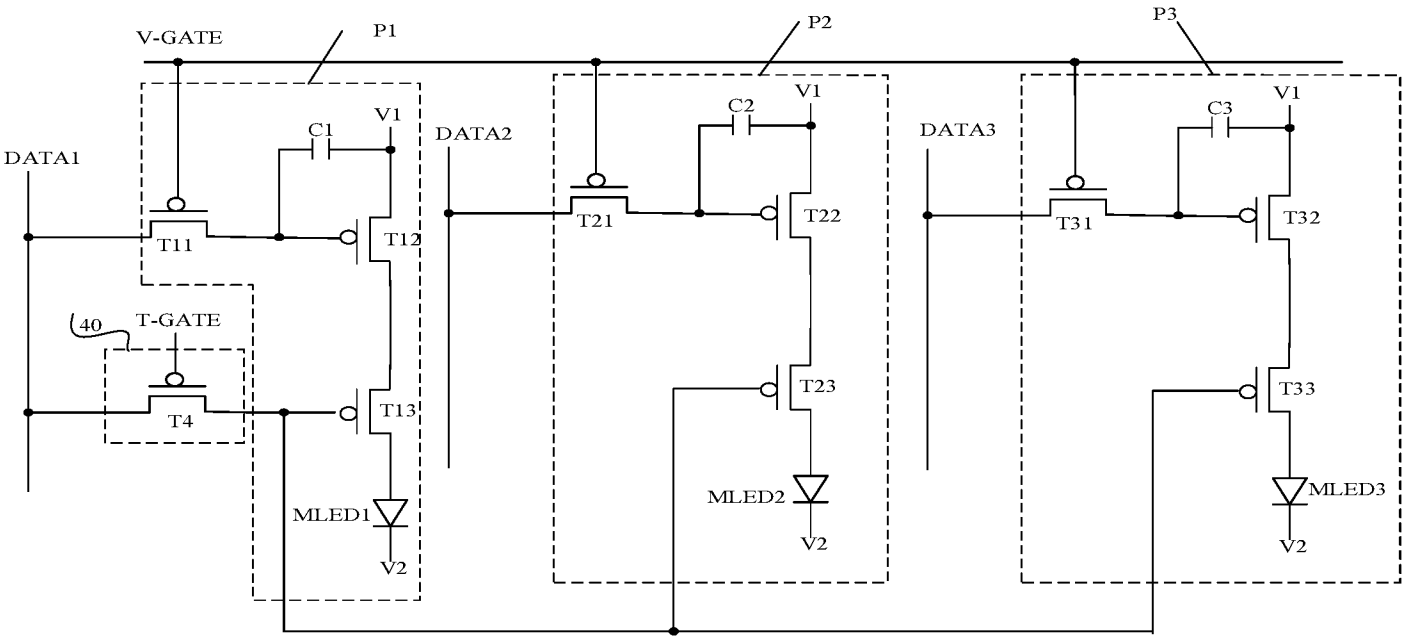
FIG. 5 is a circuit diagram of the pixel circuit according to one embodiment of the present disclosure.

As shown in FIG. 5, the pixel circuit may include one light-emitting time control circuit 40, a first subpixel circuit P1, a second subpixel circuit P2 and a third subpixel circuit P3.

The light-emitting time control circuit 40 may include a light-emitting time control transistor T4. The first subpixel circuit P1 may include a first data voltage write-in circuit, a first driving circuit, a first storage circuit, a first light-emitting control circuit and a first micro light-emitting diode MLED1. The second subpixel circuit P2 may include a second data voltage write-in circuit, a second driving circuit, a second storage circuit, a second light-emitting control circuit and a second micro light-emitting diode MLED2. The third subpixel circuit P3 may include a third data voltage write-in circuit, a third driving circuit, a third storage circuit, a third light-emitting control circuit and a third micro light-emitting diode MLED3.

The first light-emitting control circuit may include a first light-emitting control transistor T13, the first data voltage write-in circuit may include a first data voltage write-in transistor T11, the first driving circuit may include a first driving transistor T12, and the first storage circuit may include a first storage capacitor C1. The second light-emitting control circuit may include a second light-emitting control transistor T23, the second data voltage write-in circuit may include a second data voltage write-in transistor T21, the second driving circuit may include a second driving transistor T22, and the second storage circuit may include a second storage capacitor C2. The third light-emitting control circuit may include a third light-emitting control transistor T33, the third data voltage write-in circuit may include a third data voltage write-in transistor T31, the third driving circuit may include a third driving transistor T32, and the third storage circuit may include a third storage capacitor C3.

A gate electrode of the light-emitting time control transistor T4 may be connected to the light-emitting time control gate line T-GATE, a source electrode thereof may be connected to the first data line DATA1, and a drain electrode thereof may be connected to a gate electrode of the first light-emitting control transistor T13, a gate electrode of the second light-emitting control transistor T23, and a gate electrode of the third light-emitting control transistor T33.

A gate electrode of the first data voltage write-in transistor T11 may be connected to the voltage write-in control gate line V-GATE, a source electrode thereof may be connected to the first data line DATA1, and a drain electrode thereof may be connected to a gate electrode of the first driving transistor T12.

A source electrode of the first driving transistor T12 may receive the first voltage V1, and a drain electrode thereof may be connected to a source electrode of the first light-emitting control transistor T13. In this embodiment, V1 may be, but not limited to, a high voltage VDD.

A drain electrode of the first light-emitting control transistor T13 may be connected to an anode of the first micro light-emitting diode MLED1, and a cathode of the first micro light-emitting diode MLED1 may receive the second voltage V2. In this embodiment, V2 may be, but not limited to, a low voltage VSS.

A first end of the first storage capacitor C1 may be connected to the gate electrode of the first driving transistor T12, and a second end thereof may receive the first voltage V1.

A gate electrode of the second data voltage write-in transistor T21 may be connected to the voltage write-in control gate line V-GATE, a source electrode thereof may be connected to the second data line DATA2, and a drain electrode thereof may be connected to a gate electrode of the second driving transistor T22.

A source electrode of the second driving transistor T22 may receive the first voltage V1, and a drain electrode thereof may be connected to a source electrode of the second light-emitting control transistor T23. In this embodiment, V1 may be, but not limited to, a high voltage VDD.

A drain electrode of the second light-emitting control transistor T23 may be connected to an anode of the second micro light-emitting diode MLED2, and a cathode of the second micro light-emitting diode MLED2 may receive the second voltage V2. In this embodiment, V2 may be, but not limited to, a low voltage VSS.

A first end of the second storage capacitor C2 may be connected to the gate electrode of the second driving transistor T22, and a second end thereof may receive the first voltage V1.

A gate electrode of the third data voltage write-in transistor T31 may be connected to the voltage write-in control gate line V-GATE, a source electrode thereof may be connected to the third data line DATA3, and a drain electrode thereof may be connected to a gate electrode of the third driving transistor T32.

A source electrode of the third driving transistor T32 may receive the first voltage V1, and a drain electrode thereof may be connected to a source electrode of the third light-emitting control transistor T33. In this embodiment, V1 may be, but not limited to, a high voltage VDD.

A drain electrode of the third light-emitting control transistor T33 may be connected to an anode of the third micro light-emitting diode MLED3, and a cathode of the third micro light-emitting diode MLED3 may receive the second voltage V2. In this embodiment, V2 may be, but not limited to, a low voltage VSS.

A first end of the third storage capacitor C3 may be connected to the gate electrode of the third driving transistor T32, and a second end thereof may receive the first voltage V1.

In FIG. 5, all the transistors are p-type transistors. However, the p-type transistors may be replaced with n-type transistors according to the practical need.

Figure 10:
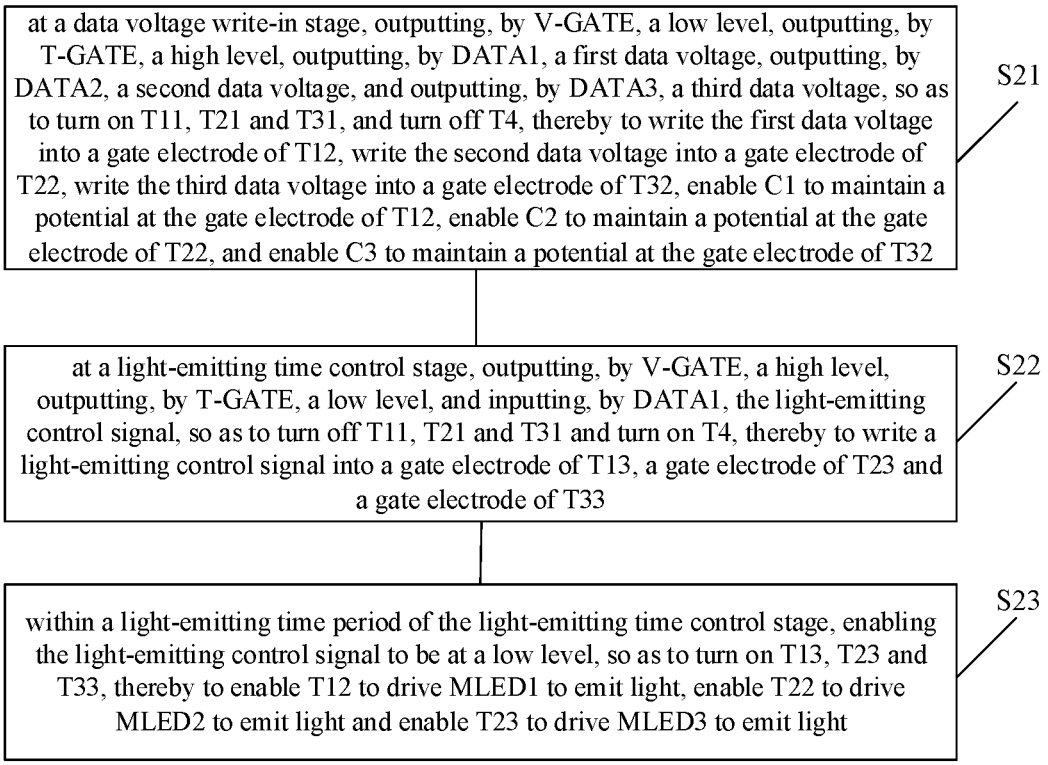
FIG. 10 is a flow chart of a method for driving the subpixel circuit in FIG. 5.

As shown in FIG. 10, the present disclosure further provides in some embodiments a method of driving the pixel circuit in FIG. 5, which includes: Step S21 of, at the data voltage write-in stage, outputting, by V-GATE, a low level, outputting, by T-GATE, a high level, outputting, by DATA1, the first data voltage, outputting, by DATA2, the second data voltage, and outputting, by DATA3, the third data voltage, so as to turn on T11, T21 and T31, and turn off T4, thereby to write the first data voltage into the gate electrode of T12, write the second data voltage into the gate electrode of T22, write the third data voltage into the gate electrode of T32, enable C1 to maintain the potential at the gate electrode of T12, enable C2 to maintain the potential at the gate electrode of T22, and enable C3 to maintain the potential at the gate electrode of T32; Step S22 of, at the light-emitting time control stage, outputting, by V-GATE, a high level, outputting, by T-GATE, a low level, and inputting, by DATA1, the light-emitting control signal, so as to turn off T11, T21 and T31 and turn on T4, thereby to write the light-emitting control signal into the gate electrode of T13, the gate electrode of T23 and the gate electrode of T33; and Step S23 of, within the light-emitting time period of the light-emitting time control stage, enabling the light-emitting control signal to be at a low level, so as to turn on T13, T23 and T33, thereby to enable T12 to drive MLED1 to emit light, enable T22 to drive MLED2 to emit light and enable T23 to drive MLED3 to emit light.

A length of the light-emitting time may depend on a pulse width of the light-emitting control signal, and the light-emitting brightness value of each micro light-emitting diode may depend on the corresponding data voltage and the light-emitting time.

Figure 6:
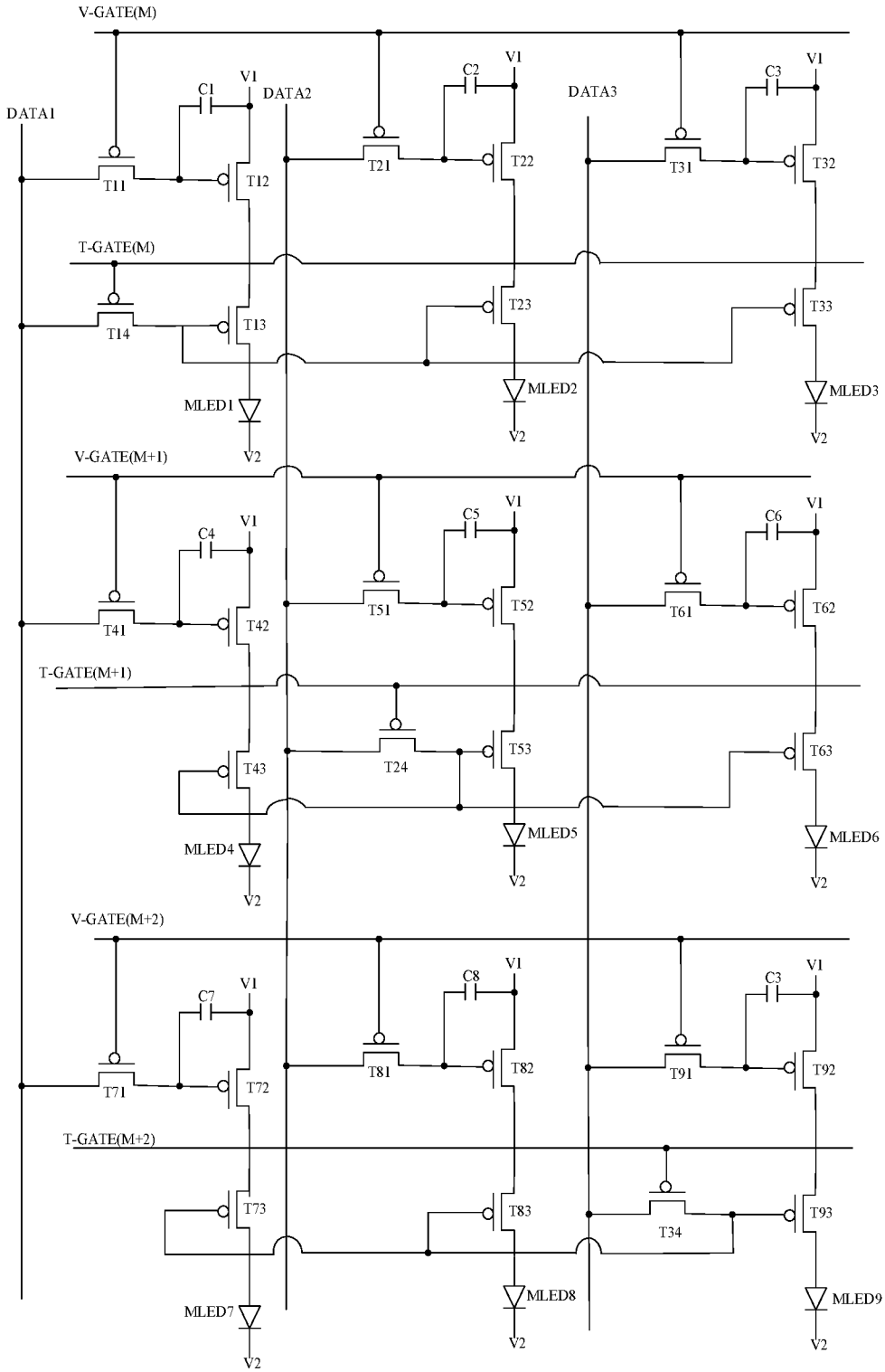
FIG. 6 is a schematic view showing a display module including three pixel circuits when each pixel circuit includes three data lines according to one embodiment of the present disclosure.

FIG. 6 shows a display module including three pixel circuits when each pixel circuit includes three data lines.

As shown in FIG. 6, V-GATE(M) represents an $M^{th}$ voltage write-in control gate line, T-GATE(M) represents an $M^{th}$ light-emitting time control gate line, V-GATE(M+1) represents an $(M+1)^{th}$ voltage write-in control gate line, T-GATE(M+1) represents an $(M+1)^{th}$ light-emitting time control line, V-GATE(M+2) represents an $(M+2)^{th}$ voltage write-in control gate line, and T-GATE(M+2) represents an $(M+2)^{th}$ light-emitting time control gate line, where M is a positive integer.

In FIG. 6, T14 represents a first light-emitting time control transistor, T24 represents a second light-emitting time control transistor, and T34 represents a third light-emitting time control transistor. A source electrode of T14 is connected to the first data line DATA1, a source electrode of T24 is connected to the second data line DATA2, and a source electrode of T34 is connected to the third data line DATA3.

T11 represents a data voltage write-in transistor in an $M^{th}$ row and a first column, T12 represents a driving transistor in an $M^{th}$ row and a first column, T13 represents a light-emitting control transistor in an $M^{th}$ row and a first column, and C1 represents a storage capacitor in an $M^{th}$ row and a first column. T21 represents a data voltage write-in transistor in the $M^{th}$ row and a second column, T22 represents a driving transistor in the $M^{th}$ row and a second column, T23 represents a light-emitting control transistor in the $M^{th}$ row and a second column, and C2 represents a storage capacitor in the $M^{th}$ row and a second column. T31 represents a data voltage write-in transistor in the $M^{th}$ row and a third column, T32 represents a driving transistor in the $M^{th}$ row and a third column, T33 represents a light-emitting control transistor in the $M^{th}$ row and a third column, and C3 represents a storage capacitor in the $M^{th}$ row and a third column.

T41 represents a data voltage write-in transistor in an $(M+1)^{th}$ row and the first column, T42 represents a driving transistor in an $(M+1)^{th}$ row and the first column, T43 represents a light-emitting control transistor in an $(M+1)^{th}$ row and the first column, and C4 represents a storage capacitor in an $(M+1)^{th}$ row and the first column. T51 represents a data voltage write-in transistor in the $(M+1)^{th}$ row and the second column, T52 represents a driving transistor in the $(M+1)^{th}$ row and the second column, T53 represents a light-emitting control transistor in the $(M+1)^{th}$ row and the second column, and C5 represents a storage capacitor in the $(M+1)^{th}$ row and the second column. T61 represents a data voltage write-in transistor in the $(M+1)^{th}$ row and the third column, T62 represents a driving transistor in the $(M+1)^{th}$ row and the third column, T63 represents a light-emitting control transistor in the $(M+1)^{th}$ row and the third column, and C6 represents a storage capacitor in the $(M+1)^{th}$ row and the third column.

T71 represents a data voltage write-in transistor in an $(M+2)^{th}$ row and the first column, T72 represents a driving transistor in an $(M+2)^{th}$ row and the first column, T73 represents a light-emitting control transistor in an $(M+2)^{th}$ row and the first column, and C7 represents a storage capacitor in an $(M+2)^{th}$ row and the first column. T81 represents a data voltage write-in transistor in the $(M+2)^{th}$ row and the second column, T82 represents a driving transistor in the $(M+2)^{th}$ row and the second column, T83 represents a light-emitting control transistor in the $(M+2)^{th}$ row and the second column, and C8 represents a storage capacitor in the $(M+2)^{th}$ row and the second column. T91 represents a data voltage write-in transistor in the $(M+2)^{th}$ row and the third column, T92 represents a driving transistor in the $(M+2)^{th}$ row and the third column, T93 represents a light-emitting control transistor in the $(M+2)^{th}$ row and the third column, and C9 represents a storage capacitor in the $(M+2)^{th}$ row and the third column.

Figure 7:
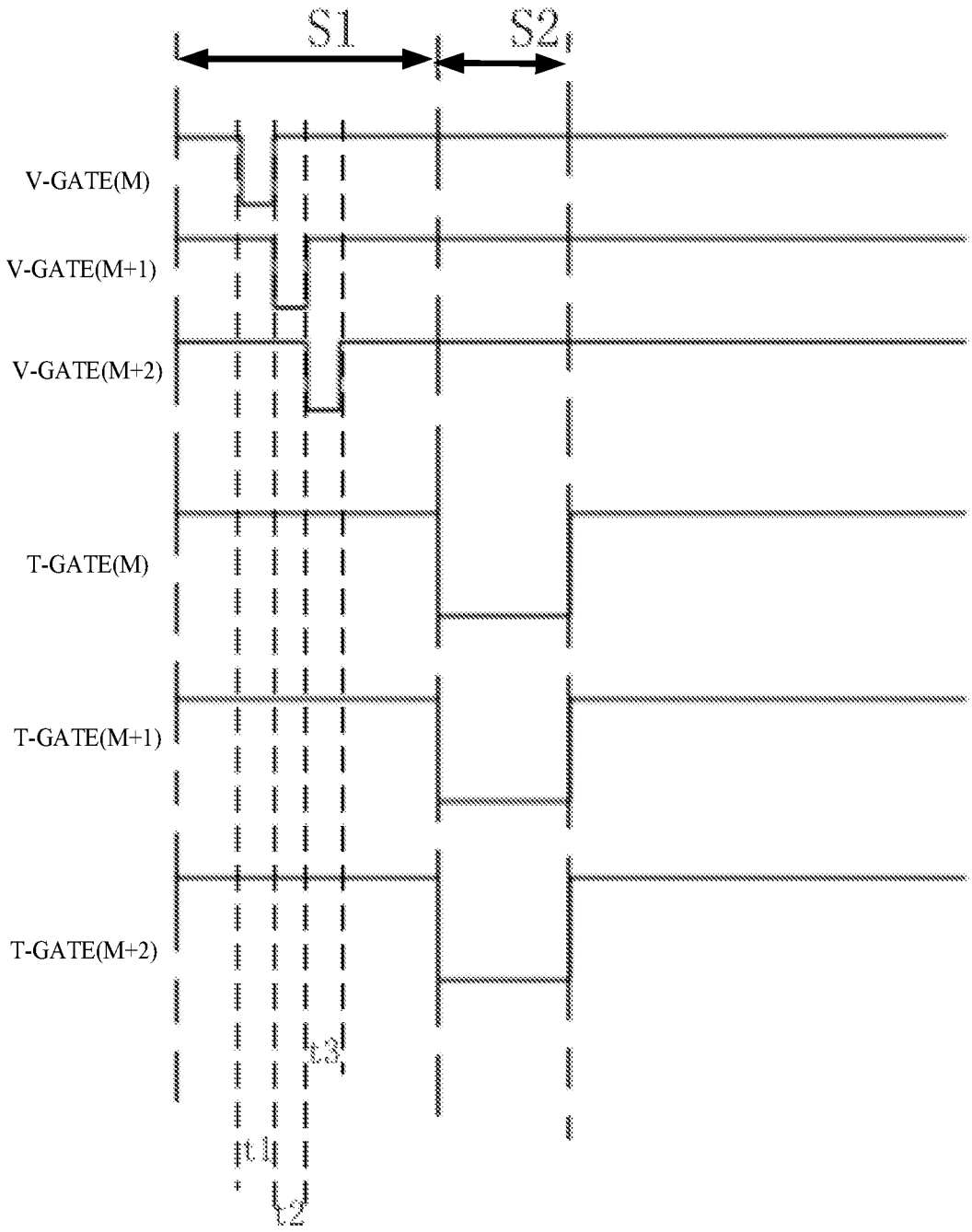
FIG. 7 is a time sequence diagram of the display module in FIG. 6.

As shown in FIG. 7, at the data voltage write-in stage S1, T-GATE(M), T-GATE(M+1) and T-GATE(M+2) may each output a high level.

Within an $M^{th}$ data voltage write-in time period t1 of the data voltage write-in stage, V-GATE(M) may output a low level, and V-GATE(M+1) and V-GATE(M+2) may each output a high level, so as to write the first data voltage from DATA1 into the gate electrode of T12 through T11 in an on state, write the second data voltage from DATA2 into the gate electrode of T22 through T21 in an on state, and write the third data voltage from DATA3 into the gate electrode of T32 through T31 in an on state.

Within an $(M+1)^{th}$ data voltage write-in time period t2 of S1, V-GATE(M+1) may output a low level, and V-GATE(M) and V-GATE(M+2) may each output a high level, so as to write the first data voltage from DATA1 into the gate electrode of T42 through T41 in an on state, write the second data voltage from DATA2 into the gate electrode of T52 through T51 in an on state, and write the third data voltage from DATA1 into the gate electrode of T62 through T61 in an on state.

Within an $(M+2)^{th}$ data voltage write-in time period t3 of S1, V-GATE(M+2) may output a low level, and V-GATE(M) and V-GATE(M+1) may each output a high level, so as to write the first data voltage from DATA1 into the gate electrode of T72 through T71 in an on state, write the second data voltage from DATA2 into the gate electrode of T82 through T81 in an on state, and write the third data voltage from DATA1 into the gate electrode of T92 through T91 in an on state.

At the light-emitting time control stage S2, V-GATE(M), V-GATE(M+1) and V-GATE(M+2) may each output a high level, and T-GATE(M), T-GATE(M+1) and T-GATE(M+2) may each output a low level. At this time, a first light-emitting control signal from DATA1 may be written into the gate electrode of T12, the gate electrode of T22 and the gate electrode of T32, so as to enable MLED1, MLED2 and MLED3 to emit light within a first light-emitting time period of S2 (a duration of the first light-emitting time period is a duration in which the first light-emitting control signal is at a low level). A second light-emitting control signal from DATA2 may be written into the gate electrode of T42, the gate electrode of T52 and the gate electrode of T62, so as to enable MLED4, MLED5 and MLED6 to emit light within a second light-emitting time period of S2 (a duration of the second light-emitting time period is a duration in which the second light-emitting control signal is at a low level). A third light-emitting control signal from DATA3 may be written into the gate electrode of T72, the gate electrode of T82 and the gate electrode of T92, so as to enable MLED7, MLED8 and MLED9 to emit light within a third light-emitting time period of S2 (a duration of the third light-emitting time period is a duration in which the third light-emitting control signal is at a low level).

Figure 11:
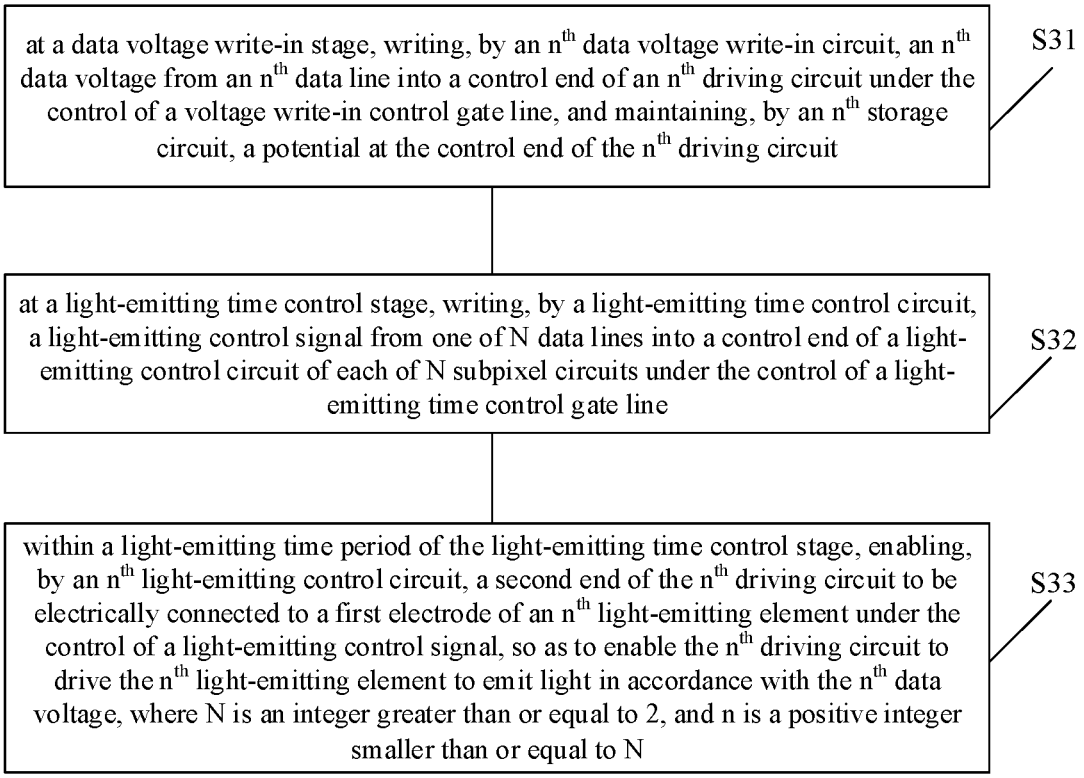
FIG. 11 is a flow chart of a method for driving the pixel circuit according to one embodiment of the present disclosure.

The present disclosure further provides in some embodiments a method of driving the above-mentioned pixel circuit. A display period of the pixel circuit includes a data voltage write-in stage and a light-emitting time control stage arranged one after another. As shown in FIG. 11, the method may include: Step S31 of, at the data voltage write-in stage, writing, by an $n^{th}$ data voltage write-in circuit, an $n^{th}$ data voltage from an $n^{th}$ data line into a control end of an $n^{th}$ driving circuit under the control of a voltage write-in control gate line, and maintaining, by an $n^{th}$ storage circuit, a potential at the control end of the $n^{th}$ driving circuit; Step S32 of, at the light-emitting time control stage, writing, by a light-emitting time control circuit, a light-emitting control signal from one of N data lines into a control end of a light-emitting control circuit of each of N subpixel circuits under the control of a light-emitting time control gate line; and Step S33 of, within a light-emitting time period of the light-emitting time control stage, enabling, by an $n^{th}$ light-emitting control circuit, a second end of the $n^{th}$ driving circuit to be electrically connected to a first electrode of an $n^{th}$ light-emitting element under the control of a light-emitting control signal, so as to enable the $n^{th}$ driving circuit to drive the $n^{th}$ light-emitting element to emit light in accordance with the $n^{th}$ data voltage, where N is an integer greater than or equal to 2, and n is a positive integer smaller than or equal to N.

The present disclosure further provides in some embodiments a pixel circuit connected to N data lines and including N above-mentioned subpixel circuits, where N is an integer greater than or equal to 2. A light-emitting time control circuit of each subpixel circuit is connected to a corresponding data line of the N data lines.

Figure 8:
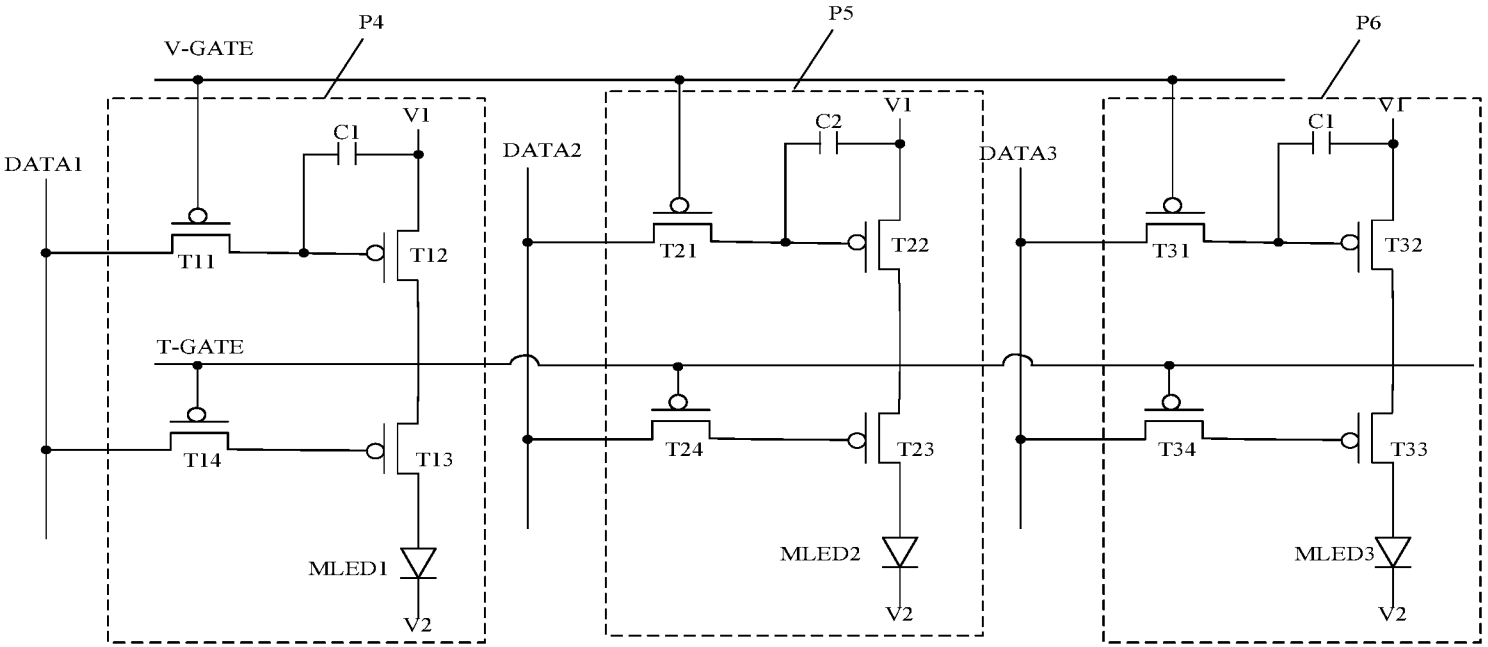
FIG. 8 is another circuit diagram of the pixel circuit according to one embodiment of the present disclosure.

As shown in FIG. 8, the pixel circuit may include a first subpixel circuit P4, a second subpixel circuit P5 and a third subpixel circuit P6. Each of the first subpixel circuit P4, the second subpixel circuit P5 and the third subpixel circuit P6 may be one of a red subpixel circuit, a green subpixel circuit and a blue subpixel. For example, the first subpixel circuit P4 may be the red subpixel circuit, the second subpixel circuit P5 may be the green subpixel circuit, and the third subpixel circuit P6 may be the blue subpixel circuit.

Structures of the first subpixel circuit P4, the second subpixel circuit P5 and the third subpixel circuit P6 may be the same as that of the subpixel circuit in FIG. 3.

The first subpixel circuit P4 may include a first data voltage write-in transistor T11, a first driving transistor T12, a first storage capacitor C1, a first light-emitting time control transistor T14 and a first light-emitting control transistor T13. A source electrode of T14 may be connected to the first data line DATA1.

The second subpixel circuit P5 may include a second data voltage write-in transistor T21, a second driving transistor T22, a second storage capacitor C2, a second light-emitting time control transistor T24 and a second light-emitting control transistor T23. A source electrode of T24 may be connected to the second data line DATA2.

The third subpixel circuit P6 may include a third data voltage write-in transistor T31, a third driving transistor T32, a third storage capacitor C3, a third light-emitting time control transistor T34 and a third light-emitting control transistor T33. A source electrode of T34 may be connected to the third data line DATA3.

In FIG. 8, MLED1 represents a first micro light-emitting diode, MLED2 represents a second micro light-emitting diode, MLED3 represents a third light-emitting diode, DATA1 represents a first data line, DATA2 represents a second data line, DATA3 represents a third data line, V-GATE represent a voltage write-in control gate line, and T-GATE represents a light-emitting time control gate line.

In FIG. 8, all the transistors may be p-type transistors. However, in actual use, the transistors may also be n-type transistors.

The present disclosure further provides in some embodiments a display device including the above-mentioned pixel circuit.

The display device may be any product or member having a display function, e.g., mobile phone, flat-panel computer, television, display, laptop computer, digital photo frame or navigator.

According to the subpixel circuit, the pixel circuit, the driving methods thereof and the display device in the embodiments of the present disclosure, as compared with the related art, the light-emitting control signal is applied through the light-emitting time control circuit, so as to control the light-emitting time, and control the brightness value of the light-emitting element in accordance with the data voltage and the light-emitting time, thereby to improve the luminous efficiency and reduce the power consumption.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel circuit connected to N data lines and comprising one light-emitting time control circuit and N subpixel circuits, N being an integer greater than or equal to 2, wherein the light-emitting time control circuit is connected to a light-emitting time control gate line, a control end of a light-emitting control circuit of each of the N subpixel circuits, and one of the N data lines, and configured to, at a light-emitting time control stage, write a light-emitting control signal from the one data line into the control end of the light-emitting control circuit of each of the N subpixel circuits under the control of the light-emitting time control gate line;

an $n^{th}$ subpixel circuit comprises an $n^{th}$ data voltage write-in circuit, an $n^{th}$ driving circuit, an $n^{th}$ storage circuit, an $n^{th}$ light-emitting control circuit and an $n^{th}$ light-emitting element, where n is a positive integer smaller than or equal to N;

the $n^{th}$ data voltage write-in circuit is connected to a voltage write-in control gate line, a control end of the $n^{th}$ driving circuit and an $n^{th}$ data line of the N data lines, and configured to, at a data voltage write-in stage, write an $n^{th}$ data voltage from the $n^{th}$ data line into the control end of the $n^{th}$ driving circuit under the control of the voltage write-in control gate line;

a first end of the $n^{th}$ driving circuit is connected to a first voltage input end, a second end of the $n^{th}$ driving circuit is connected to a first end of the $n^{th}$ light-emitting control circuit, a second end of the $n^{th}$ light-emitting control circuit is connected to a first electrode of the nth light-emitting element, and a second electrode of the $n^{th}$ light-emitting element is connected to a second voltage input end;

a first end of the $n^{th}$ storage circuit is connected to the control end of the $n^{th}$ driving circuit, and a second end of the $n^{th}$ storage circuit is connected to the first voltage input end;

the $n^{th}$ storage circuit is configured to control a potential at the control end of the $n^{th}$ driving circuit; and the $n^{th}$ light-emitting control circuit is configured to, within a light-emitting time period of the light-emitting time control stage, enable the second end of the $n^{th}$ driving circuit to be electrically connected to the first electrode of the $n^{th}$ light-emitting element under the control of the light-emitting control signal, so as to enable the $n^{th}$ driving circuit to drive the $n^{th}$ light-emitting element to emit light in accordance with the $n^{th}$ data voltage.

2. The pixel circuit according to claim 1, wherein the light-emitting time control circuit comprises a light-emitting time control transistor, a gate electrode of which is connected to the light-emitting time control gate line, a first electrode of which is connected to the one data line of the N data lines, and a second electrode of which is connected to the control end of the light-emitting control circuit.

3. The pixel circuit according to claim 1, wherein the $n^{th}$ light-emitting control circuit comprises an $n^{th}$ light-emitting control transistor, a gate electrode of which is a control end of the $n^{th}$ light-emitting control circuit, a first electrode of which is the first end of the $n^{th}$ light-emitting control circuit, and a second electrode of which is the second end of the $n^{th}$ light-emitting control circuit.

4. The pixel circuit according to claim 1, wherein the $n^{th}$ data voltage write-in circuit comprises an $n^{th}$ data voltage write-in transistor, a gate electrode of which is connected to the voltage write-in control gate line, a first electrode of which is connected to the $n^{th}$ data line, and a second electrode of which is connected to the control end of the $n^{th}$ driving circuit.

5. The pixel circuit according to claim 1, wherein the $n^{th}$ driving circuit comprises an $n^{th}$ driving transistor, a gate electrode of which is the control end of the $n^{th}$ driving circuit, a first electrode of which is the first end of the $n^{th}$ driving circuit, and a second electrode of which is the second end of the $n^{th}$ driving circuit, wherein the $n^{th}$ storage circuit comprises an $n^{th}$ storage capacitor, a first end of which is connected to the control end of the $n^{th}$ driving circuit, and a second end of which is connected to the first voltage input end.

6. A method of driving the pixel circuit according to claim 1, wherein a display period of the pixel circuit comprises a data voltage write-in stage and a light-emitting time control stage arranged one after another, wherein the method comprises:

at the data voltage write-in stage, writing, by an $n^{th}$ data voltage write-in circuit, an $n^{th}$ data voltage from an $n^{th}$ data line into a control end of an $n^{th}$ driving circuit under the control of a voltage write-in control gate line, and maintaining, by an $n^{th}$ storage circuit, a potential at the control end of the $n^{th}$ driving circuit;

at the light-emitting time control stage, writing, by a light-emitting time control circuit, a light-emitting control signal from one of N data lines into a control end of a light-emitting control circuit of each of N subpixel circuits under the control of a light-emitting time control gate line; and within a light-emitting time period of the light-emitting time control stage, enabling, by an $n^{th}$ light-emitting control circuit, a second end of the $n^{th}$ driving circuit to be electrically connected to a first electrode of an $n^{th}$ light-emitting element under the control of a light-emitting control signal, so as to enable the $n^{th}$ driving circuit to drive the $n^{th}$ light-emitting element to emit light in accordance with the $n^{th}$ data voltage, where N is an integer greater than or equal to 2, and n is a positive integer smaller than or equal to N.

7. A display module connected to N data lines and comprising N pixel circuits according to claim 1, N being an integer greater than or equal to 2, wherein a light-emitting time control circuit of each pixel circuit of the N pixel circuits is connected to a corresponding data line of the N data lines, and different light-emitting time control circuits of the N pixel circuits are connected to different data lines of the N data lines.

8. A display device, comprising the display module according to claim 7.

9. A display device, comprising the pixel circuit according to claim 1.

* * * * *